US005492219A

United States Patent [19]

Stupar

[11] Patent Number: 5,492,219

[45] **Date of Patent: * Feb. 20, 1996**

[54] PLURAL COMPARTMENT PACKAGE

[75] Inventor: Jeffrey M. Stupar, West Dundee, Ill.

[73] Assignee: Illinois Tool Works Inc., Glenview, Ill.

[ * ] Notice: The portion of the term of this patent subsequent to Oct. 11, 2011, has been disclaimed.

[21] Appl. No.: 262,585

[22] Filed: Jun. 20, 1994

Related U.S. Application Data

[63] Continuation-in-part of Ser. No. 21,787, Feb. 24, 1993, Pat. No. 5,353,927.

[51] Int. Cl.[6] ..... B65D 25/08

[52] U.S. Cl. ..... 206/219; 383/38

[58] Field of Search ..... 206/219, 222; 383/38, 40

[56] References Cited

U.S. PATENT DOCUMENTS

| | | | |
|---|---|---|---|
| 2,756,875 | 7/1956 | Yochim | 206/29 |
| 3,074,544 | 1/1963 | Bollmeier et al. | 206/219 |
| 3,149,943 | 9/1964 | Amador . | |
| 3,608,709 | 9/1971 | Pike . | |
| 3,756,389 | 9/1973 | Firth | 206/219 |
| 3,950,158 | 4/1976 | Gossett . | |
| 4,462,224 | 7/1984 | Dunshee et al. | 206/219 X |
| 4,519,499 | 5/1985 | Stone et al. | 206/219 |
| 4,557,377 | 12/1985 | Maloney . | |
| 4,846,585 | 7/1989 | Boeckmann et al. . | |
| 4,856,651 | 8/1989 | Francis, Jr. . | |
| 4,872,556 | 10/1989 | Farmer . | |
| 5,353,927 | 10/1994 | Stupar | 206/219 |

FOREIGN PATENT DOCUMENTS

| | | |
|---|---|---|
| 0100796 | 2/1984 | European Pat. Off. . |
| 2134067 | 8/1984 | United Kingdom . |

*Primary Examiner*—Paul T. Sewell
*Assistant Examiner*—Ted Kavanaugh
*Attorney, Agent, or Firm*—Schwartz & Weinrieb

[57] ABSTRACT

A plural compartment package for housing and storing at least two different materials which are to be mixed together so as to form a compound mixture at the time of use comprises first, second, and third sheets of film material with the third sheet of film interposed between the first and second sheets of film. The three sheets of film material have substantially the same length and width dimensions and are peripherally sealed to each other such that the peripheral seal of the package comprises a three-layer laminate. In addition, the third intermediate sheet of film is secured at a mid-point thereof to one of the first and second sheets of film such that three compartments are formed within the package. The third sheet of film material is provided with easily rupturable perforations so as to facilitate discharge of one material from one compartment into another compartment for mixture with the second material, rupture occurring as a result of pressure applied to the package. A non-porous, rupturable cap overlies the rupturable perforations so as to prevent premature discharge of the first material from the first compartment into the second compartment for mixture with the second material. The pressurizing forces may be concentrated by V-shaped heat-sealed regions, and in addition, an end portion of the package may be torn off so as to define a dispensing spout for the compound mixture.

26 Claims, 3 Drawing Sheets

PLURAL COMPARTMENT PACKAGE

CROSS-REFERENCE TO RELATED PATENT APPLICATIONS:

This patent application is a continuation-in-part patent application of U.S. patent application Ser. No. 08/021,787 which was filed on Feb. 24, 1993 now U.S. Pat. No. 5,353,927.

FIELD OF THE INVENTION

The present invention relates generally to plural compartment packages, and more particularly to an improved plural compartment package which comprises at least two compartments within which two different materials are initially housed within separated compartments, whereupon the rupture of a weakened region partially defining one of the compartments containing one of the two different and separated materials, the two different materials are able to mix together so as to form a particularly desired compound.

BACKGROUND OF THE INVENTION

One type of prior art plural compartment package utilizes a bag-in-a-bag type structure for mixing two different materials together. For example, as illustrated within U.S. Pat. No. 3,950,158 which was issued on Apr. 13, 1976 to Rodger L. Gossett, an inner rupturable bag is surrounded by or encased within an outer sealed bag. When a predetermined amount of pressure is applied to or impressed upon an appropriate exterior portion of the outer sealed bag, a seal structure provided within the inner rupturable bag ruptures so as to thereby release the material contained within the inner rupturable bag whereby the contents of the inner and outer bags can then mix together so as to form the desired mixture or compound.

The aforenoted type of prior art plural compartment package structure, however, has several disadvantages. For example, it is not especially economically advantageous since is requires the use of a substantial amount of material in order to fabricate a completed package or bag structure since, in effect, two complete, separate bags are required to be formed in order to constitute the composite package or bag structure. In addition, it has been found that the inner rupturable bag is sometimes difficult to rupture since an inner seal must be broken in order to release the content of the inner bag. It has also proven difficult to fabricate a separating seal that has consistent burst strength since the package or bag structure, and particularly the seal structure thereof, must be fabricated in accordance with a very narrow range of processing conditions comprising variable heating, dwell time, and pressure parameters. If the seal structure is effectively too tight or rigid, that is, has a relatively high burst strength, then the seal will be difficult to burst or will not burst properly, however, on the other hand, if the seal structure is effectively too loose or is not rigid enough so as to exhibit a relatively low burst strength, the seal structure permits migration of the fluids and intermixing thereof in a premature manner whereby premature setting of the bag contents occurs.

In view of the foregoing, the aforenoted parent patent application was directed toward the disclosure of a plural compartment package whereby the aforenoted deficiencies of the prior art type of plural compartment packages would be overcome and rectified and while the plural compartment package disclosed within the noted parent patent application has in fact overcome and rectified the noted deficiencies of the prior art type of plural compartment packages, and wherein further, the plural compartment package of the noted parent patent application has been quite satisfactory from a functional or operational point of view, some difficulties have been encountered in connection with the manufacture of such a plural compartment package. For example, due to the presence of three layers of packaging material forming one peripheral end portion of the laminated composite package, while only two layers of packagin material form an opposite peripheral end portion of the laminated composite package, the pressure levels required in connection with the heat sealing process for forming the heat-sealed peripheral portions of the laminated composite package must necessarily be varied, appropriately adjusted, or controlled in order to accommodate the different thickness dimensions of the laminated composite package within the noted peripheral end regions. If an inappropriate or improper pressure level is impressed upon a particular peripheral en portion or region of the laminated composite package due, for example, to a failure to properly accommodate or compensate for the differences in the thickness dimensions of that particular peripheral end portion or region relative to the opposite peripheral end portion or region, then the heat seal formed within that particular peripheral end portion or region of the package would then be improper, incomplete, or simply insufficient from a seal-integrity point of view, whereby problems may then be encountered in connection with the leakage of the package contents. In addition, the precise adjustment or control of the requisite pressures needed to properly achieve the entire peripheral heat seal region of the composite package, wherein accommodation of or compensation for the different thickness dimensions characteristic of the opposite peripheral end portions or regions of the package must be resolved, is sometimes difficult to achieve, is time-consuming, and tedious.

There is therefore a need, to which the present invention is directed, for a plural compartment package which is not only able to achieve the objectives of the plural compartment package disclosed within the aforenoted parent patent application, whereby the problems, drawbacks, and disadvantages of the known prior art are able to be overcome, but which, in addition, is able to be readily manufactured or fabricated without encountering the aforenoted manufacturing difficulties characteristic of the plural compartment package disclosed within the parent patent application. Still further, there is also a need for a plural compartment package which can achieve consistent burst strength or burst pressure levels so as to facilitate reliable, easy, and proper mixing of the package components.

OBJECTS OF THE INVENTION

Accordingly, it is an object of the present invention to provide a new and improved plural compartment package.

Another object of the present invention is to provide a new and improved plural compartment package which can contain and store two different materials within separated compartment prior if the intended mixture of the materials and which can facilitate mixture of the materials within the package when mixture of the materials is desired at the time of use of the mixture or compound.

Still another object of the present invention is to provide a new and improved plural compartment package which can contain and store two different materials within two separate compartments prior to the intended mixture of the materials, and wherein the materials within the package can be easily and readily mixed together, so as to form the intended mixture or compound, as a result of one of the compartments of the package being easily rupturable.

Yet another object of the present invention is to provide a new and improved plural compartment package which can contain store two different materials within two separate compartments prior to the intended mixture of the materials, and wherein leakage between the two compartments is effectively prevented such that the materials of the compartments will not mix together prior to the rupture of one of the compartments at the time of intended usage.

A further object of the present invention is to provide a new and improved plural compartment package, which can contain and store two different materials within two separate compartments prior to the intended mixture of the materials, wherein the package is economically feasible to fabricate or manufacture.

Still yet another object of the present invention is to provide a new and improved plural compartment package which can contain and store two different materials within two separate compartments prior to the intended mixture of the materials, and wherein the heat sealing process of the entire peripheral region of the package can be readily achieved under heat-sealing pressurized conditions which need not accommodate or compensate for different thickness dimensions or parameters which heretofore have been chacteristic of different peripheral areas or regions of the aforenoted similar type of plural compartment package, whereby the new and improved plural compartment package of the present invention can be manufactured or fabricated without encountering the aforenoted manufacturing difficulties attendant the heat-sealing process.

A still further object of the present invention is to provide a new and improved plural compartment package which can contain and store two different materials within two separate compartments prior to the intended mixture of the materials, and wherein the pressurizing forces impressed upon the plural compartment package for achieving rupture of one of the compartments of the package at the time of intended usage can be properly focussed upon a portion of the rupturable region of the rupturable compartment of the package such that the rupturable region of the rupturable compartment of the package is easily yet properly rupturable, that is, at desirable and consistent burst pressure levels or values.

SUMMARY OF THE INVENTION

The foregoing and other objectives are achieved in accordance with the present invention through the provision of a new and improved plural compartment package for housing and storing two different materials, such as, for example, an epoxy resin and a polyamine material, which are initially disposed within separated compartments of the package and which are to be subsequently mixed together at a desired time of use so as to form an adhesive. The package comprises two sheets of film which are joined together by means of a suitable heat-sealing process so as to form the outer sealed periphery of the package, and a third sheet of film is interposed between the two outer sheets of film so as to divide the package into multiple compartments. More particularly, the multiple compartments comprise a large compartment which is substantially equal to one-half the interior volume of the entire package and within which the epoxy resin material component is disposed, a second compartment which is substantially equal to one-quarter of the interior volume of the entire package and within which the polyamine material component is disposed, and a third compartment which is also substantially equal to one-quarter of the interior volume of the entire package and which is kept empty or vacant. The second compartment is provided with a line of perforation holes which are defined within a mid portion of the third sheet of film and which are readily ruptured when a user applies a predetermined amount of pressure to the external portion of the compartment. A cap overlies the perforation holes so that the noted polyamine material component contained within the second compartment is prevented from leaking into the first compartment and mixing with the epoxy resin material component until the second compartment is intentionally ruptured such that the noted polyamine material component of the second ruptured compartment can in fact mix with the epoxy resin material component of the first compartment whereby the material mixture comprising the adhesive mixture or compound is then ready for use.

In accordance with the particular improvement of the present invention, the third sheet of film is interposed between the two outer sheets of film, comprising the outer surfaces of the completed package, in such a manner that the third sheet of film effectively extends across both the entire width and length of the completed package whereby all of the heat seals of the completed package comprise three layers of sheet film material. Consequently, there is no variance in the number of layers of sheet film material comprising the completed package laminate or the thickness dimensions of the completed package laminate regardless of the particular peripheral region or area of the completed package. In this manner, there is no need for adjusting or varying the pressure levels attending the heat-sealing process whereby manufacturing difficulties in connection with such pressure levels, and the attainment or maintenance of the same, are not encountered.

In accordance with a further improvement of the present invention, a portion of the perforation holes defined within the aforenoted mid portion of the third sheet of film are sealed closet such that only a central portion or region of the perforation holes as viewed in the widthwise direction of the package, remain intact. As a result, when the package is intentionally subjected to the external pressurizing forces in order to rupture the second compartment so as to permit the intermixing of the noted polyamine material component with the epoxy resin material component of the first compartment, the pressurizing forces are focussed or concentrated upon the central portion or region of the perforation holes whereby the rupture or bursting of the second compartment of the package is rendered substantially easier.

BRIEF DESCRIPTION OF THE DRAWINGS

Various other objects, features, and attendant advantages of the present invention will be more fully appreciated from the following detailed description, when considered in connection with the accompanying drawings, in which like reference characters designate like or corresponding parts throughout the several views, and wherein.

DETAILED DESCRIPTION OF THE ILLUSTRATED EMBODIMENTS

Figure 1:
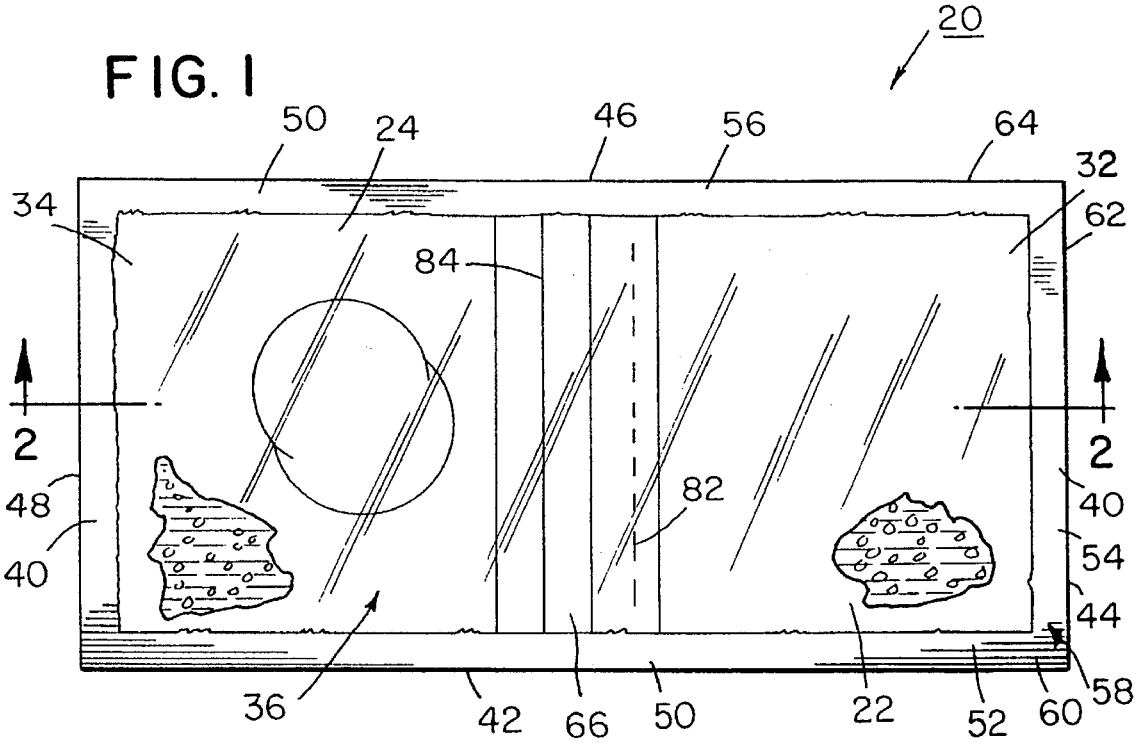
FIG. 1 is a top plan view of a plural compartment package constructed in accordance with the invention as set forth within the aforenoted parent patent application.

Referring initially to FIGS. 1–4, there is illustrated plural compartment package as disclosed within the aforenoted parent patent application and which is generally indicated by the reference character 20. The package 20 is generally used for holding or storing two different materials 22 and 24, which may be, for example, a polyamine material and an epoxy resin, respectively, although, of course, it is understood that other types of component materials can be similarly packaged. The materials 22 and 24 are adapted to be mixed together so as to form, for example, an adhesive, and therefore, it is understood that the package 20 is used only once and then discarded once the materials 22 and 24 have been mixed together so as to form the particular mixture or compound, such as, for example, the adhesive.

Figure 2:
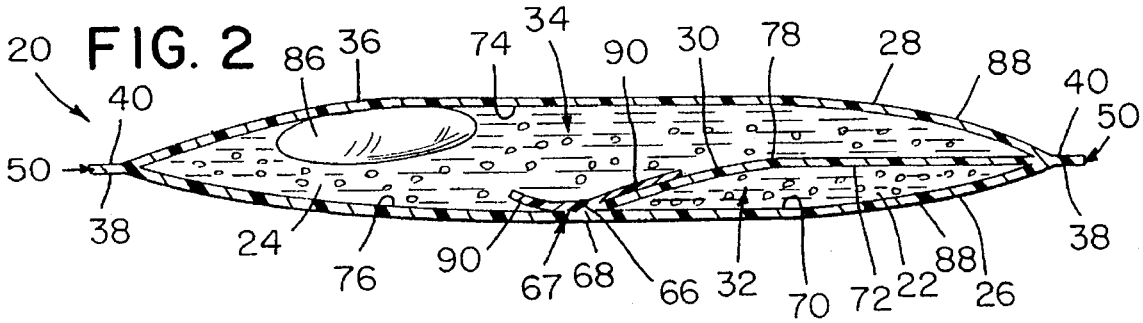
FIG. 2 is a cross-sectional view of the plural compartment package of FIG. 1 as taken along the lines 2—2 of FIG. 1.
Figure 3:
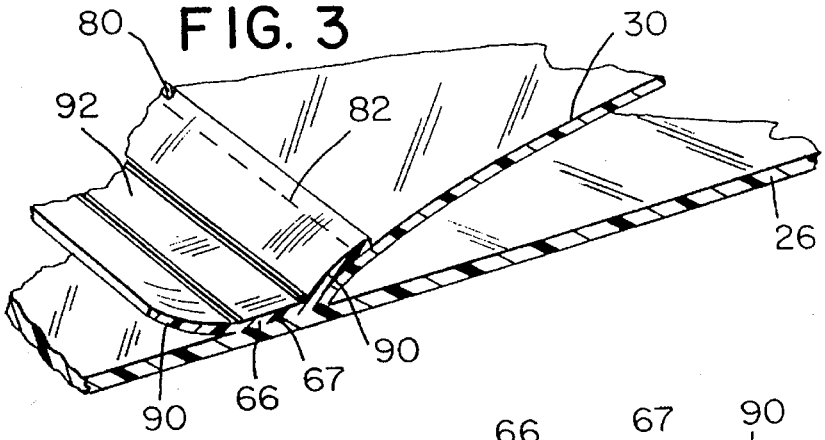
FIG. 3 is a partial cross-sectional and perspective detailed view of the heat-seal connection defined between the first and third sheets of film which comprise the plural compartment package of FIGS. 1 and 2.
Figure 4:
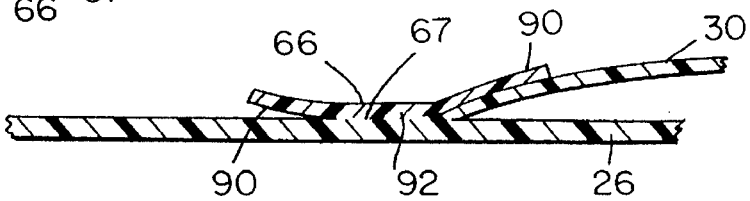
FIG. 4 is a partial cross-sectional detailed view of the heat-seal connection defined between the first and third sheets of film which comprise the plural compartment package of FIGS. 1

As best seen from FIG. 2, the package 20 comprises three flexible sheets of film 26, 28, and 30, which may comprise a suitable thermoplastic material and which are joined together so as to form a plurality of separated compartments 32 and 34. More particularly, the package 20 is divided into two separate compartments 32 and 34 wherein the compartment 34 is substantially larger than the compartment 32. Each one of the compartments 32 and 34 contains or holds one of the material components 22 and 24, and in accordance with the illustrated embodiment, the larger compartment 34 houses the epoxy resin material component 24 while the smaller compartment 32 houses the polyamine material component 22.

Still referring to FIG. 2, it is seen that a first one of the sheets of film 26 and a second one of the sheets of film 28 are joined together so as to form outer or external wall members 36 of the completed package 20, the sheets of film 26 and 28 being of substantially equal size and substantially completely overlapping each other when the package 20 is assembled. The sheets of film 26 and 28 may have any one of several different geometrical configurations, and in accordance with the illustrated embodiment, the sheets of film 26 and 28 are seen to be rectangular. In order to join the sheets of film 26 and 28 together, peripheral areas 38 and 40, respectively, of each one of the sheets of film 26 and 28 are bonded to each other, by means of, for example, a suitable heat-sealing process, along each one of the longitudinal and lateral edge portions 42, 44, 46, and 48 so as to form a peripheral, heat-sealed region 50 which extends about the entire periphery of the package 20.

Continuing still further, and as briefly noted hereinabove, the compartments 32 and 34 that contain and store the component materials 22 and 24 are further defined by means of the interdisposition of the third sheet of film 30 between the first and second sheets of film 26 and 28. The third sheet of film 30 has a width dimension which is equal to that of the outer rectangular sheets of film 26 and 28, however, the length of the third sheet of film 30 is only approximately one-half that of the first and second sheets of film 26 and 28. In this manner, three peripheral edge portions 60, 62, and 64 of the third sheet of film 30 are adapted to be heat-sealed to peripheral edge portions 52, 54, and 56 of the first and second sheets of film 26 and 28 such that a three-layer laminated heat-sealed region, generally indicated by reference character 58, is defined within one half of the package 20, region 58 comprising only a portion of the overall peripheral heat-sealed region 50. As best seen in FIG. 2, the fourth side 66 of the third sheet of film 30 is substantially attached only to the first sheet of film 26, it being appreciated, however, that the lateral end portions of the fourth side 66 of the third sheet of film 30 will be encompassed within and form an integral part of the heat-sealed region 58, whereby such lateral end portions of the fourth side 66 of the third sheet of film 30 will therefore also be attached to the second sheet of film 28. As more particularly or best disclosed within FIG. 2, the fourth side 66 of the third sheet of film 30 is fixedly secured to the first sheet of film 26, within the entire, substantially central portion of side 66, that is, that portion of side 66 which does not include the lateral end portions encompassed within the heat-sealed region 58, by appropriate means, such as, for example, a heat seal bonded region 67. As has been noted herein above, while the length of the third sheet of film 30 is approximately one-half the length of the first and second sheets of film 26 and 28, whereby the heat-sealed bonded region 67 is essentially defined or formed at a mid-point 68 taken along the length of the first sheet of film 26, the third sheet of film 30 could have a length dimension which is different than that specifically illustrated, that is, the length of the third sheet of film 30 could be somewhat less than or more than one-half the length of the first sheet of film 26, provided the objective of rendering the third sheet of film 30 readily rupturable, as will become more apparent hereinafter, is not adversely compromised.

With reference still being made to FIG. 2, it is seen that part of the inner wall or surface 70 of the first sheet of film 26, that is, the right half of tile interior surface of the first sheet of film 26 as viewed in FIG. 2, along with one side or surface 72 of the third sheet of film 30, define the smaller compartment 32 within which the polyamine material component 22 is disposed, while the larger compartment 34, within which the epoxy resin material 24 is disposed, is defined by means of the inner surface or wall 74 of the second sheet of film 28, the inner surface or wall 76 comprising the other half of the first sheet of film 26, and the other side or surface 78 of the third sheet of film 30. Each one of the sheets of film 26, 28, and 30 are preferably formed from a suitable thermoplastic material, which is preferably heat-sealable, such as, for example, polypropylene or the like.

In order to facilitate the release of tile polyamine material component 22 which is contained and stored within the smaller compartment 32 so as to permit the polyamine material component to mix with tile epoxy resin material component 24 that is contained and stored within the larger compartment 34, a weakened area 80 is formed within one end of the third sheet of material 30 so as to permit the smaller compartment 32 to burst as a result of a predetermined amount of external pressure applied to the package 20. More particularly, the weakened area 80 comprises a line of perforations 82 which extend laterally across substantially the entire width of the third sheet of material 30 and are located at a position which is longitudinally offset from the free edge portion 84 of the fourth side 66 of the third sheet of material 30, as well as the heat seal region 67, so as to extend parallel to the heat seal region 67.

In accordance with the preferred embodiment of the invention, the smaller compartment 32 is substantially completely filled with the noted polyamine material component 22, while the larger compartment 34 is filled with .the epoxy resin material component 24 to an extent which equals only approximately three-quarters of the volume of the compartment 34. As a result of the smaller compartment 32 being almost completely filled with the polyamine material component 22, the smaller compartment 32 is rendered more easily rupturable when the aforenoted predetermined amount of pressure is applied externally to the package 20. Depending upon the amount of the polyamine material 22 and epoxy resin material 24 which is disposed within the respective compartments 32 and 34, air bubbles 86 may be formed within the compartments 32 and 34, and it is of course understood that various different amounts of materials may be used or contained within the compartments 32 and 34 depending upon the particularly desired mixture or compound to be formed.

In use, that is, when it is desired to form the desired mixture or compound from the separated polyamine and epoxy resin materials 22 and 24, pressure is impressed upon the external portion 88 of the smaller compartment 32 whereby the polyamine material 22 disposed within the compartment 32 will be forced against the line of perforations 82 and, in turn, will apply pressure to the weakened area 80. When the applied pressure impressed upon the weakened area 80 becomes too great and exceeds the bursting strength limit of the weakened area 80 as defined in part by means of the perforations 82, the line of perforations 82 will burst apart or burst open thereby releasing the polyamine material 22 into the compartment 34 so as to mix with the epoxy resin in material 24. Thereafter, the user continues to apply pressure along the entire external surface portion 88 of the package 20 so as to substantially flatten the smaller compartment 32 and completely discharge substantially all of the polyamine material 22 contained therein such that substantially all of the polyamine material 22 is forced into the larger compartment 34 within which the epoxy resin material 24 is disposed. In order to form or complete the formation of the final adhesive compound, the user kneads the entire exterior portion of the package 20 so as to insure complete mixing of the polyamine material and epoxy resin materials 22 and 24 together. After the noted polyamine and epoxy resin materials 22 and 24 have been completely mixed to as to form the adhesive compound, the adhesive is readily dispensed from the package age 20 as a result of, for example, suitable pressure again being applied to external portions of the package 20 after the package 20 has been appropriately cut or torn, for example, at one end thereof.

In order to prevent tile noted polyamine material 22 disposed within the smaller compartment 32 from prematurely leaking into the larger compartment 34 containing the epoxy resin material 24, a thin membrane or frangible cap 90 is provided within the package 20 so as o completely cover the line of perforations 82 of the weakened area 80. The frangible cap or membrane 90 is fabricated from a suitable thermoplastic material similar to that comprising the first, second, and third sheets of film material 26, 28, and 30, that is, for example, polypropylene or the like. As a result of this particular fabrication of the cap or membrane 90, the same is able to be attached to the third sheet of film 30, along the surface 78 thereof so as to be disposed externally of the smaller compartment 32, by suitable means, such as, for example, a heat-sealing operation. More particularly, a part 92 of the cap or membrane 90 is incorporated within the heat-sealed region 67, as best seen from FIGS. 3 and 4, which bonds the fourth side 66 of the third sheet of film 30 to the first sheet of film 26. When pressure is then applied to the external portion 88 of the smaller compartment 32 of the package 20, the Doted polyamine material 22 disposed within the smaller compartment 32 is caused to pressurize the weakened area 80 of the third sheet of film 30, and when the pressure reaches a predetermined level, the line of perforations 82 will burst open, the frangible cap or membrane 90 will also be fracture and the noted polyamine material 22 disposed within the smaller compartment 32 will be released therefrom and discharged into the larger compartment 34 so as to become mixed with the epoxy resin material 24 disposed therein for formation of the compound adhesive as described above. When the membrane or cap 90 is fractured, part of the cap or membrane 90 remains sealed or attached to one part of the third sheet of film 30 disposed upon one side of the line of perforations 82, and the other part of the cap or membrane 90 remains sealed or attached to the other part of tile third sheet of film 30 disposed upon the opposite side of the line or perforations 82. For additional disclosure as to the perforation/cap or membrane structure, reference is made to U.S. Pat. Nos. 4,846,585 and 5,023,122 which are assigned to MINIGRIP, INC., a subsidiary of ILLINOIS TOOL WORKS INC., the assignee of record of the present patent application, the aforenoted patent disclosures being incorporated ed herein by reference.

In lieu of the membrane or cap 90 being entirely heat-sealed to the external surface portion of the third sheet of film material 30 forming the smaller compartment 32, only one side portion of the membrane or cap 90 may be incorporated or captured within the heat-sealed region 67 while the remaining portion of the membrane or cap 90 is bonded to the external surface portion of the third sheet of film material 30 by means of a suitable light adhesive. Consequently, when pressure is applied to the external portion 88 of the package 20 which defines, in part, the smaller compartment 32, the noted polyamine material 22 disposed within the smaller compartment 32 pressurizes the weakened area 80, and when the pressure level attains a predetermined value, the line of perforations 82 bursts open, the light adhesive material releases the membrane or cap 90 from the external surface portion of the third sheet of film material 30, the other portion of the membrane or cap 90 still being incorporated and retained within the heat-sealed region 67, and the noted polyamine material 22 disposed within the smaller compartment 32 will be released therefrom and discharged into the larger compartment 34 so as to become mixed with the epoxy resin material 24 disposed therein for formation of the compound adhesive as described above.

As can be appreciated from the foregoing, the package of the invention disclosed within FIGS. 1–4 exhibits various operational and economic advantages, such as, for example, the fact that the epoxy resin material 24 and the polyamine material 22 can be quickly and readily mixed together so as to form the desired compound adhesive as a result of the easily rupturable smaller compartment 32. In addition, since the structure of the bag or package 20 of this invention does not comprise the conventional bag-in-a-bag structure, but to the contrary, comprises a package structure wherein the smaller compartment 32 is partially formed or defined by means of one of the outer package sheets of film, that is, film sheet 26, less packaging material is required which is economically advantageous from a manufacturing point of view.

While the package 20 of the embodiment illustrated within FIGS. 1–4 has the noted operational and economic advantages, as has also been noted hereinbefore, some difficulties have been encountered in connection with the actual manufacture of the package 20 of the embodiment illustrated within FIGS. 1–4. In particular as can be appreciated from FIG. 2, heat-sealed peripheral edge portion 50 formed within the right end portion of the package 20 as viewed in FIG. 2 is seen to comprise a three-layer laminated section made up of a portion of the first sheet of film material 26, a portion of the second sheet of film material 28, and a portion of the third sheet of film material 30. However, the heat-sealed peripheral edge portion 50 formed within the left end portion of the package 20 as viewed in FIG. 2 is seen to comprise only a two-layer laminated section made up of a portion of the first sheet of film material 26 and a portion of the second sheet of film material 28, the left end portion of the third sheet of film material 30, as viewed in FIG. 2, having terminated at the heat-sealed bonded region 67 located at essentially the mid-point 68 of the first sheet of film material 26. Accordingly, in view of this variance in the thickness dimensions characterizing the different laminated peripheral edge portions of the package 20, that is, due to one laminated peripheral edge portion comprising a three-layer laminate while an other laminated peripheral edge portion comprises a two-layer laminate, the pressure levels required in connection with the heat-sealing process for forming the different heat-sealed peripheral edge portions of the package must necessarily be varied, appropriately adjusted, or controlled in order to achieve the proper seal exhibiting the requisite integrity characteristics while accommodating or compensating for the different thickness dimensions of the noted peripheral edge portions of the package. The precise adjustment or control of the requisite pressures needed to properly attain the entire peripheral heat seal region of the composite package, however, is sometimes difficult to achieve, is time-consuming, and is tedious. In addition, if an inappropriate or improper pressure level is impressed upon a particular peripheral edge portion or region of the laminated composite package due, for example, to a failure to properly accommodate or compensate for the differences in the thickness dimensions of the different peripheral edge portions of the package, then the heat seal formed within a particular peripheral edge portion or region of the package would then be improper, incomplete, or simply insufficient from a seal-integrity point of view, whereby problems may then be encountered in connection with the leakage of the package contents.

Figure 5:
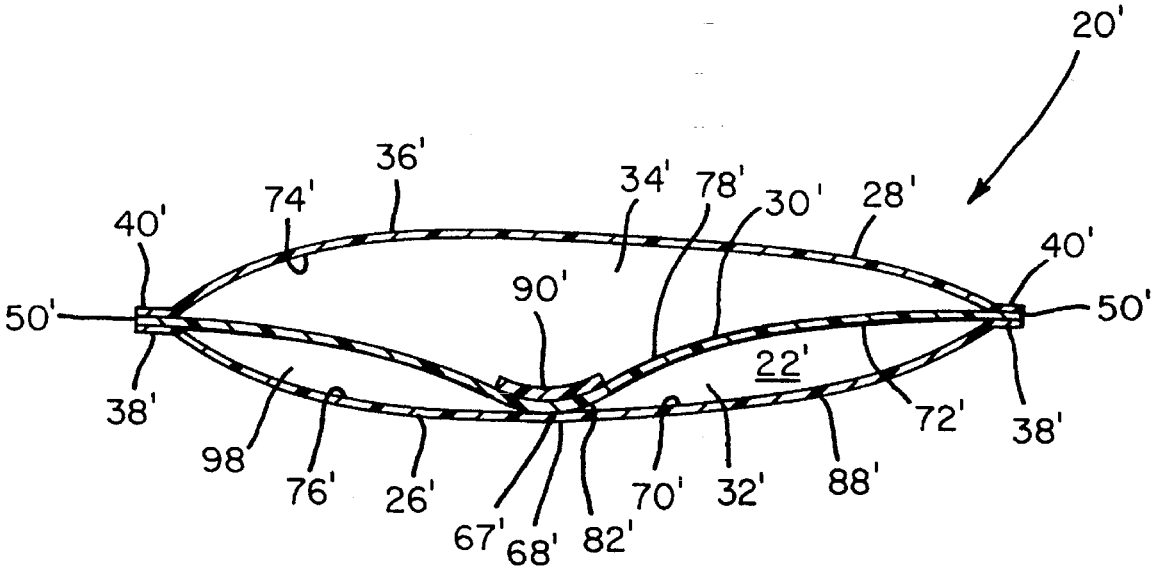
FIG. 5 is a cross-sectional view similar to that of FIG. 2, showing however, the improved plural compartment package constructed in accordance with the present invention.

In accordance with an improved embodiment of a plural compartment package which forms the basis of the present patent application, and which is illustrated within FIG. 5, the foregoing difficulties have been effectively resolved. With reference being made to FIG. 5, the new and improved plural compartment package of the present invention is generally indicated by the reference character 20', and it is noted that in connection with this invention embodiment, as compared to the embodiment of FIGS. 1–4, like or corresponding parts have been provided the same reference characters, although in the embodiment of FIG. 5, the similar reference characters wilt have the added designation (').

Consequently, it is seen for example, that the new and improved plural compartment package 20' is comprised of a first sheet of film material 26', a second sheet of film material 28', and a third sheet of film material 30'. More particularly, the first sheet of film material 26' may comprise a polyester/foil/polypropylene laminate which is sold under the product Number E16036-98 by AMERICAN NATIONAL CAN, 2301 Industrial Drive, Neenah, Wis. 54957; the second film sheet material 28' may comprise a clear or transparent polyester/polyester/poly-propylene laminate which is sold under the product Number 90/002PP CLEAR by CLEAR LAM PACKAGING, INC., 1950 Pratt Boulevard, Elk Grov Village, Ill. 60007-5993; and the third or middle film sheet material 30' may comprise a polypropylene/foil/polypropylene laminate which is sold under the product Number E-16111-93 by AMERICAN NATIONAL CAN as noted above. The third sheet of film material 30' is provided with perforations 82' as in the case of the embodiment of FIGS. 1–4, and a membrane or cap 90' overlies the perforation: 82' so as to cover the same and prevent leakage of the polyamine material 22' disposed within the small compartment 32' out from the compartment 32'. The membrane or cap member 90' may be fabricated from an ethylene-methyl-acrylate copolymer resin sold by the EXXON CORPORATION under their product number designation EXXON TC-120, wherein the thickness of such a membrane or cap is approximately 0.002". The perforations 82' formed within the third sheet of film material 30' are approximately 0.120" long, and the spacing defined between adjacent perforations is approximately 0.020". The particular epoxy resin material 24' and polyamine material 22' which may be disposed with the plural compartment package 20' of the present invention may be any one of various different epoxy resin materials, such as, for example, those sold under the product names of BRAND MERCHANDISING/DEVCON FIVE-MINUTE EPOXY, TWO-TON EPOXY, and FIVE-MINUTE EPOXY GEL. The epoxy resin material 24' disposed within the larger compartment 34' is colored with pH sensitive blue ink or dye such that the epoxy material 24' can be seen through the clear or transparent sheet material 28' and the noted polyamine material 22' is disposed within the smaller compartment 32' so as not to react with the clear or transparent sheet of film material 28'.

As can be readily appreciated from a comparison of the embodiments illustrated within FIG. 2 and 5, the primary difference comprising the present invention of this patent application, as compared to the invention of the noted parent patent application, resides in the fact that the third or intermediate sheet of film material 30' does not terminate within the seal-bonded region 67' located at the midpoint 68' of the first sheet of film material 26' as in the case of the embodiment of FIG. 2, but to the contrary, the third or intermediate sheet of film material 30' extends the entire length of the package 20', although the third sheet of film material 30' is in fact heat-sealed or bonded at its midpoint to the midpoint location 68' of the first sheet of film material 26' so as to define therewith the heat-sealed bonded region 67'. In this manner, not only does the third sheet of film material 30' serve to define, along with the first sheet of film material 26', the smaller compartment 32' for housing or containing the polyamine material 22', but more importantly, and in addition, the continued longitudinal extent of the third sheet of film material 30' permits the left end terminal portion of the third sheet of film material 30', as viewed in FIG. 5, to comprise one of the laminated layers of the peripheral heat-sealed region 50' formed within the left end portion of the package 20' as viewed in FIG. 5. It is therefore seen that the dimensional thickness of the peripheral heat-sealed region 50' formed within the left end portion of the package 20', as viewed in FIG. 5, is equal to the dimensional thickness of the peripheral heat-sealed region 50' formed within the right end portion of the package 20'. Consequently, only a single pressure level is required to be developed and controlled for achieving the heat-sealed region 50' throughout the entire periphery of the composite package 20', or in other words, various different pressure levels need not be attained, adjusted, controlled, or maintained depending upon the particular thickness dimension of the particular peripheral heat-sealed region 50' of the package 20'. Accordingly, the manufacturing difficulties which may be attendant the embodiment of the package 20 illustrated within FIGS. 1–4 are no longer present or have been effectively resolved by means of the present invention embodiment illustrated within FIG. 5.

It is noted from further consideration of the embodiment of FIG. 5 that with the particular structure of the third sheet of film material 30', that is, its longitudinal extent and the manner in which it is secured at essentially its midpoint to the midpoint 68' of the first sheet of film material 26', that a third separated compartment 98 is formed within the package 20' and this compartment 98 is seen to be defined by means of the half-portion of the first sheet of film material 26' which is not used to form the compartment 32', and similarly by means of the remaining half-portion of the third sheet of film material 30' which is likewise not used to form the second or smaller compartment 32'. The compartment 98 is substantially the same size as compartment 32', and in accordance with the preferred embodiment of the present invention, compartment 98 remains vacant whereby the positive attributes or characteristics of the package 20' are achieved and maintained in connection with the mixture or formation of a two-component mixture or compound comprising the epoxy resin material and the noted polyamine material. It is however, possible that if a three-component mixture or compound was desired to be formed from three different materials housed or contained within the package 20', a third mixture or compound component could be disposed and stored within the third compartment 98, it being additionally recognized, however, that additional means, similar to the rupturable perforation means 82' of the second compartment 32' would have to be provided in conjunction with the third compartment 98 so as to permit the discharge of the third mixture or compound component from the compartment 98 into the primary or first compartment 34' for mixture with the mixture or compound component 24' disposed within the first compartment 34' at the time of desired use of the three-component mixture or compound.

It is also noted that the package 20' may be envisioned as essentially comprising only two compartments wherein each one of the two compartments would be substantially equal in size with respect to each other. This type of package would be formed by disposing the third sheet of film material 30' intermediate the first and second sheets of film material 26' and 28' such that the third sheet of film material 30' would extend essentially straight across the interior portion of the package 20' and would not comprise any central heat-sealed region 67'. It has been found, however, that this structure is not in fact a preferred structure from an operational efficacy viewpoint in view of the fact that the requisite pressure level needed to rupture, for example, the perforations 82', would be difficult to attain in view of the location of the perforations 82' at a substantially remote, interior location within the package 20' relative to an external surface portion of the package 20' upon which the external pressures would be impressed, as well as the relatively large volume of the compartment through which such external pressures would have to be transmitted.

Figure 6:
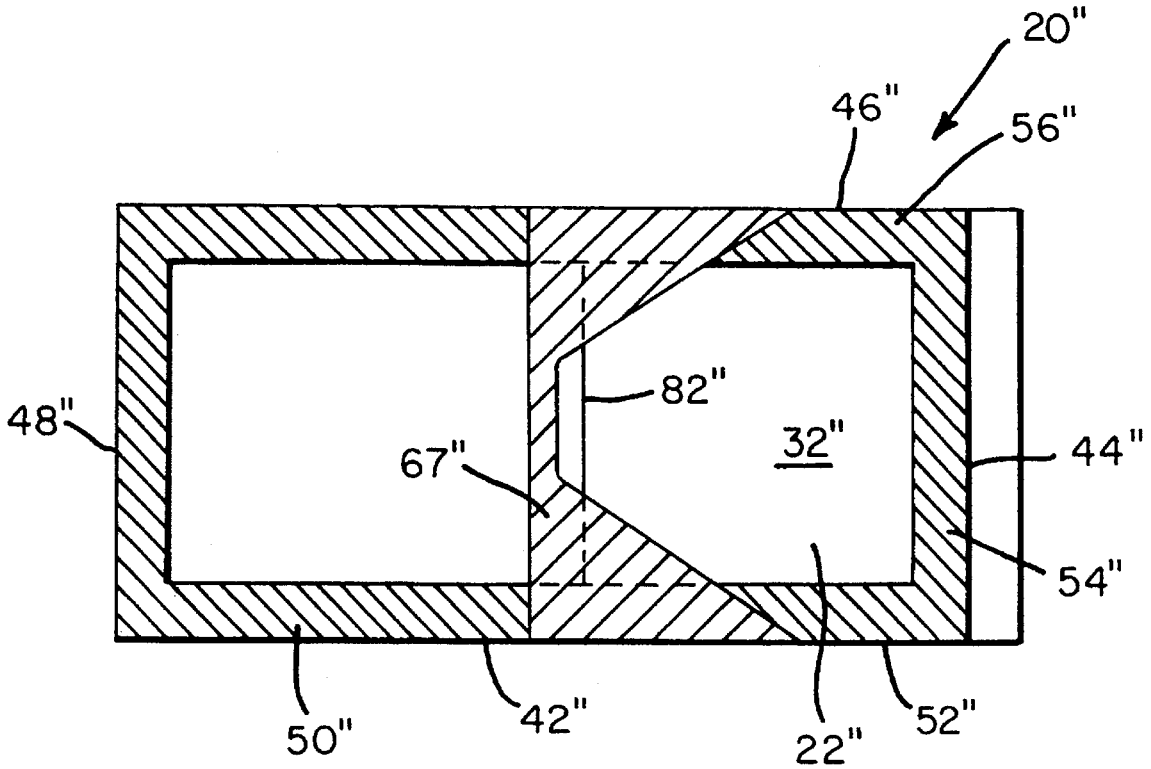
FIG. 6 is a horizontal cross-sectional view of the improved plural compartment package of FIG. 5 showing an improved heat seal defined between the first and third sheets of film which comprise the plural compartment package of FIG. 5.

Referring now to FIG. 6, a further embodiment or modification of the package shown in FIG. 5 is illustrated within this drawing figure and is designated generally by the reference character 20". This embodiment is essentially identical to the embodiment 20' of FIG. 5 with the exception that the heat sealed region defined between the central portion of the third sheet of film material and the first sheet of film material, and designated by the reference character 67", has a substantially V-shaped configuration and cuts across the laterally spaced portions of the perforations 82" so as to likewise seal the same thereby only leaving the central perforations 82" open. In this manner, when the package 20" is pressurized so as to burst the perforations 82" and provide mixing between the noted polyamine material 22" disposed within the smaller compartment 32" with the epoxy resin material disposed within the larger compartment, the pressurized forces are focussed or concentrated upon the central perforations 82" thereby facilitating easier bursting of such perforations 82" with a greater or larger degree of consistency, particularly in view of the relatively small amount of the noted polyamine material 22" disposed within the smaller compartment 32" and upon which the external pressurized forces are impressed when use of the package 20" is desired.

Figure 7:
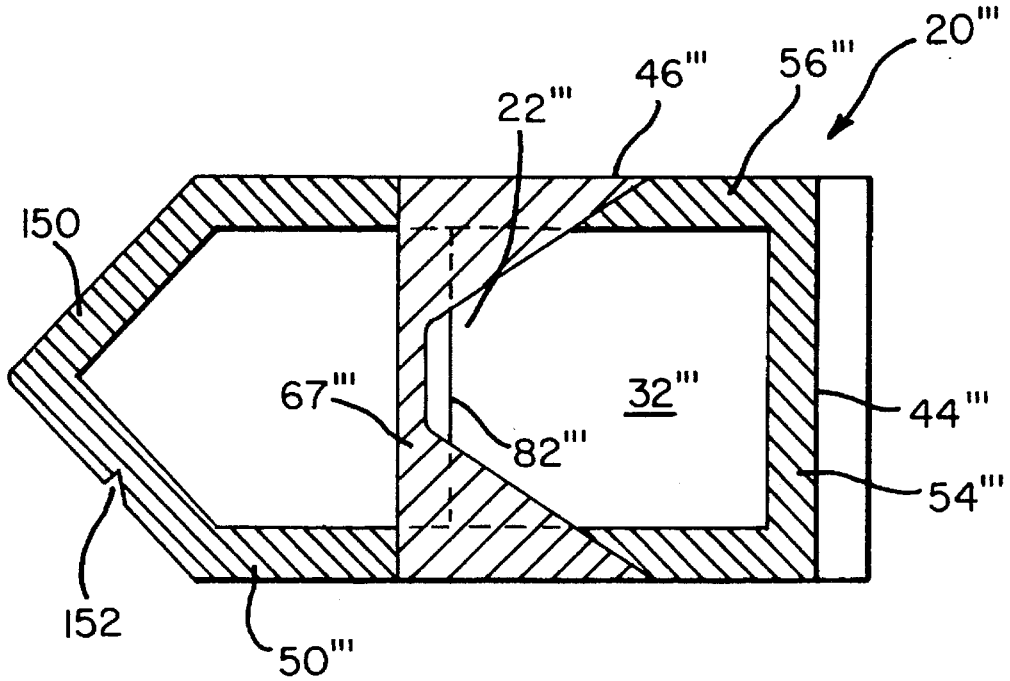
FIG. 7 is a horizontal cross-sectional view similar to that of FIG. 6 showing, however, a modified embodiment of a sealed plural compartment package constructed in accordance with the present invention.

Lastly, with reference being made to FIG. 7, a still further embodiment of the present invention package of FIG. 5 is illustrated and is generally indicated by the reference character 20''', all corresponding parts being indicated by similar reference characters except that they are additionally noted as including the designation (''') just as the corresponding parts of the embodiment of FIG. 6 were denoted by the additional designation (''). The embodiment of FIG. 7 is also essentially similar to the embodiment of FIG. 6 as including the substantially V-shaped seal 67''' such that only central perforations 82''' are open whereby the aforenoted pressure concentration or focussing can be achieved when the pressurizing forces are impressed upon the package 20''' under use conditions. In addition, however, it is noted that the left side of the package 20''' as viewed in FIG. 7, and which will be noted as being the dispensing side of the package 20''', has a pointed configuration or section 150 and a notched portion 152 is defined within a peripheral region of the pointed section 150. In this manner, once the polyamine material and epoxy resin material components have been mixed and kneaded together internally within the package 20''' and it is desired to actually dispense the adhesive mixture or compound from the package 20''', the front end or left side of the package 20''' may be opened by tearing off pointed section 150 from the package 20''' as facilitated by notched portion 152. In this manner, once the pointed section 150 has been torn off from the package 20''', a dispensing spout is effectively formed upon the front end or left side of the package 20''' for facilitating dispensing of the adhesive compound or mixture from the package 20'''.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by means of Letters Patent of the United States of America, is:

1. A plural compartment package for containing and facilitating subsequent mixture of at least two separated, different materials, comprising:

a first sheet of film material having a first peripheral region;

a second sheet of film material having a second peripheral region and overlapping said first sheet of film material such that said first and second peripheral regions of said first and second sheets of film material are joined together so as to form a peripheral region of said package and to define an interior space within said package between said first and second sheets of film material;

a third sheet of film material having a third peripheral region and interposed between said first and second sheets of film material so as to divide said interior space defined within said package into at least two separated compartments for holding at least two different material components to be subsequently mixed together, said third peripheral region of said third sheet of film material being joined to said first and second peripheral regions of said first and second sheets of material such that all areas of said peripheral region of said package comprise a three-layer laminate formed by said first, second, and third peripheral regions of said first, second, and third sheets of film material;

rupturable means provided upon said third sheet of film material for permitting rupture thereof upon the application of a predetermined amount of pressure to said package so as to permit a second one of said at least two material components disposed within a second one of said at least two separated compartments to be discharged from said second one of said at least two separated compartments and into a first one of said at least two separated compartments so as to mix with a first one of said at least two material components so as to form a compound mixture between said at least two material components; and non-porous, rupturable cap means secured to said third sheet of film material and overlying said rupturable means of said third sheet of film material for preventing discharge of said second one of said at least two material components from said second one of said at least two separated compartments until said application of said predetermined amount of pressure to said package ruptures both said rupturable means of said third sheet of film material and said rupturable cap means whereby said second one of said at least two material components is discharged from said second one of said at least two separated compartments and into said first one of said at least two separated compartments so as to mix with said first one of said at least two material components.

2. A package as set forth in claim 1, wherein:

said first one of said at least two separated compartments is defined between said first sheet of film material and said third sheet of film material; and said second one of said at least two separated compartments is defined between said second sheet of film material and said third sheet of film material.

3. A package as set forth in claim 2, wherein:

said third sheet of film material is fixedly attached at a mid-point section thereof to a mid-point section of said second sheet of film material so as to define three separated compartments within said package.

4. A package as set forth in claim 1, wherein:

said rupturable means comprises a plurality of rupturable perforations defined within said third sheet of film material.

5. A package as set forth in claim 4, further comprising:

heat seal means defined between said first and third sheets of film material for closing all of said rupturable perforations of said third sheet of film material except central ones of said rupturable perforations as considered in a lateral direction of said package such that said predetermined amount of pressure applied to said package is concentrated at said central ones of said rupturable perforations.

6. A package as set forth in claim 5, wherein:

said heat seal means has a substantially V-shaped configuration.

7. A package as set forth in claim 4, wherein:

said rupturable cap means is fixedly secured to said third sheet of film material so as to cover said plurality of rupturable perforations in order to prevent premature leakage of said second one of said at least two material components from said second one of said at least two separated compartments of said package prior to rupture of said plurality of perforations as a result of said application of said predetermined amount of pressure to said package.

8. A package as set forth in claim 7, wherein:

said rupturable cap means is heat-sealed to said third sheet of film material so as to be ruptured along with said plurality of perforations when said predetermined amount of pressure is applied to said package.

9. A package as set forth in claim 7, wherein:

said rupturable cap means is secured to said third sheet of film material by means of a light adhesive which releases said rupturable cap means from said third sheet of film material upon said rupture of said plurality of perforations when said predetermined amount of pressure is applied to said package.

10. A package as set forth in claim 1, wherein:

said first, second, and third peripheral regions of said first, second, and third sheets of film material are heat-sealed together so as to form said peripheral region of said package.

11. A package as set forth in claim 1, wherein:

said first, second, and third sheets of film material comprise polypropylene.

12. A package as set forth in claim 1, wherein:

said first one of said at least two material components comprises a polyamine material; and said second one of said at least two material components comprises an epoxy resin material.

13. A package as set forth in claim 1, further comprising:

notch means defined within an end portion of said package for facilitating tearing off said end portion of said package and thereby defining a dispensing spout from which said compound mixture may be dispensed from said package.

14. A plural compartment package for containing and facilitating subsequent mixture of at least two separated, different materials, comprising:

a first sheet of film material having a predetermined length dimension and a predetermined width dimension so as to define a first peripheral region;

a second sheet of film material having a predetermined length dimension and a predetermined width dimension which are substantially equal to said predetermined length and width dimensions of said first sheet of film material so as to define a second peripheral region which is substantially equal to said first peripheral region of said first sheet of film material so as to permit said second sheet of film material to overlap said first sheet of film material such that said first and second peripheral regions of said first and second sheets of film may be joined together so as to form a peripheral region of said package and to define an interior space within said package between said first and second sheets of film material;

a third sheet of film material having a predetermined length dimension and a predetermined width dimension so as to define a third peripheral region, and being interposed between said first and second sheets of film material so as to divide said interior space defined within said package into at least two separated compartments for holding at least two different material components to be subsequently mixed together; said predetermined length and width dimensions, and said third peripheral region, of said third sheet of film material being respectively substantially equal to said predetermined length and width dimensions, and said first and second peripheral regions, of said first and second sheets of film material so as to permit said third peripheral region of said third sheet of film material to be joined to said first and second peripheral regions of said first and second sheets of film material such that all areas of said peripheral region of said package comprise three-layer laminates formed by said first, second, and third peripheral regions of said first, second, and third sheets of film material;

rupturable means provided upon said third sheet of film material for permitting rupture thereof upon the application of a predetermined amount of pressure to said package so as to permit a second one of said at least two material components disposed within a second one of said at least two separated compartments to be discharged from said second one of said at least two separated compartments and into a first one of said at least two separated compartments so as to mix with a first one of said at least two material components so as to form a compound mixture between said at least two material components; and non-porous, rupturable cap means secured to said third sheet of film material and overlying said rupturable means of said third sheet of film material for preventing discharge of said second one of said at least two material components from said second one of said at least two separated compartments until said application of said predetermined amount of pressure to said package ruptures both said rupturable means of said third sheet of film material and said rupturable cap means whereby said second one of said at least two material components is discharged from said second one of said at least two separated compartments and into said first one of said at least two separated compartments so as to mix with said first one of said at least two material components.

15. A package as set forth in claim 14, wherein:

said first one of said at least two separated compartments is defined between said first sheet of film material and said third sheet of film material; and said second one of said at least two separated compartments is defined between said second sheet of film material and said third sheet of film material.

16. A package as set forth in claim 15, wherein:

said third sheet of film material is fixedly attached at a mid-point section thereof to a mid-point section of said second sheet of film material so as to define three separated compartments within said package.

17. A package as set forth in claim 14, wherein:

said rupturable means comprises a plurality of rupturable perforations defined within said third sheet of film material.

18. A package as set forth in claim 17, further comprising:

heat seal means defined between said first and third sheets of film material for closing all of said rupturable perforations of said third sheet of film material except central ones of said rupturable perforations as considered in a lateral direction of said package such that said predetermined amount of pressure applied to said package is focussed at said central ones of said rupturable perforations.

19. A package as set forth in claim 18, wherein:

said heat seal means has a substantially V-shaped configuration.

20. A package as set forth in claim 17, wherein:

said rupturable cap means is fixedly secured to said third sheet of film material so as to cover said plurality of rupturable perforations in order to prevent premature leakage of said second one of said at least two material components from said second one of said at least two separated compartments of said package prior to rupture of said plurality of perforations as a result of said application of said predetermined amount of pressure to said package.

21. A package as set forth in claim 20, wherein:

said rupturable cap means is heat-sealed to said third sheet of film material so as to be ruptured along with said plurality of perforations when said predetermined amount of pressure is applied to said package.

22. A package as set forth in claim 20, wherein:

said rupturable cap means is secured to said third sheet of film material by means of a light adhesive which releases said rupturable cap means from said third sheet of film material upon said rupture of said plurality of perforations when said predetermined amount of pressure is applied to said package.

23. A package as set forth in claim 14, wherein:

said first, second, and third peripheral regions of said first, second, and third sheets of film material are heat-sealed together so as to form said peripheral region of said package.

24. A package as set forth in claim 14, wherein:

said first, second, and third sheets of film material comprise polypropylene.

25. A package as set forth in claim 14, wherein:

said first one of said at least two material components comprises a polyamine material; and said second one of said at least two material components comprises an epoxy resin material.

26. A package as set forth in claim 14, further comprising:

notch means defined within an end portionof said package for facilitating tearing off said end portion of said package and thereby defining a dispensing spout from which said compound mixture may be dispensed from said package.

* * * * *